United States Patent [19]

Bourne et al.

[11] Patent Number: 4,917,373

[45] Date of Patent: Apr. 17, 1990

[54] INTERACTIVE SYSTEM FOR SELF-ACCOMPANIMENT BY MOBILE PERFORMERS

[76] Inventors: Nicholas H. Bourne, Coombe House Cottages, Coombe Fishacre, Newton Abbot, Devon; Alan J. Smith, 7 Francis Close, Lee-on-Solent, Gosport, Hampshire, both of United Kingdom

[21] Appl. No.: 240,129

[22] PCT Filed: Dec. 31, 1987

[86] PCT No.: PCT/GB87/00927

§ 371 Date: Aug. 29, 1988

§ 102(e) Date: Aug. 29, 1988

[87] PCT Pub. No.: WO88/04948

PCT Pub. Date: Jul. 14, 1988

[30] Foreign Application Priority Data

Jan. 3, 1987 [GB] United Kingdom ..... 8700043

[51] Int. Cl.[4] ..... A63G 5/00

[52] U.S. Cl. ..... 272/9; 272/1 R

[58] Field of Search ..... 272/1 R, 9, 24, 57 A; 84/1.01, 1.24, 1.27

[56] References Cited

U.S. PATENT DOCUMENTS 3,749,810 7/1973 Dow ..... 84/1.24

FOREIGN PATENT DOCUMENTS 2152404 4/1973 Fed. Rep. of Germany .
3112727 10/1982 Fed. Rep. of Germany .
2041686 2/1971 France .
2573901 5/1986 France .

*Primary Examiner*—Richard E. Chilcot, Jr.
*Attorney, Agent, or Firm*—Leydig, Voit & Mayer

[57] ABSTRACT

The system involves irradiating a performance zone with microwave energy of a frequency of the order of 10.69 GHz and placing a doppler effect sensor where it can pick up reflections from a moving performer and produce signals indicative of movement of any part of the performer. At the same time, other sensors arranged in a spatial matrix covering the performance zone produce signals indicative of instantaneous position. The outputs of all sensors are processed by a master control unit which in turn governs the output of a visual or audio channel, or both. The spatial matrix can be in the form of intersecting infrared laser beams or pressure or proximity sensors in the floor of the performance zone.

12 Claims, 1 Drawing Sheet

INTERACTIVE SYSTEM FOR SELF-ACCOMPANIMENT BY MOBILE PERFORMERS

Figure 1:
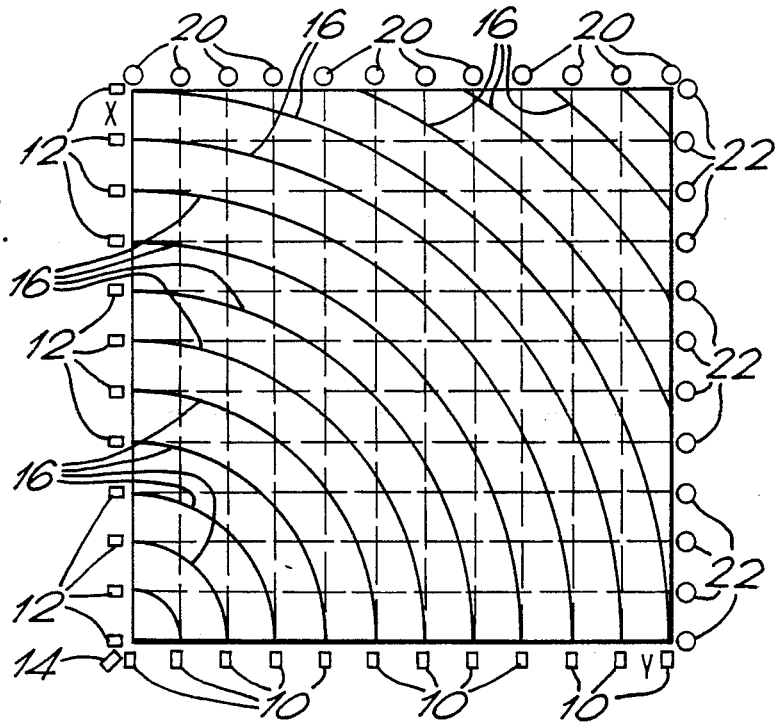

This invention relates to a system for self-accompaniment by mobile performers in the presentation of dance, gymnastic or other expressive movements. In this specification, the term "performer" denotes any movable body—animate or inanimate—which executes movements, whether impromptu, rehearsed or externally controlled, within a designated space or performance zone and, in so doing, interacts with sensors or transducers responsive to excitation whether directly through physical contact with the performer or indirectly through modification by the performer of an electromagnetic field established in the performance zone. Artistic skill or intuitive interpretation are not prerequisites of a performer seeking self-accompaniment although it will be understood that the appeal of the invention is primarily to the human capacity for aesthetic appreciation of conscious individual or group activity. Thus, although dance or gymnastic performances are envisaged as being the principal occasions for self-accompaniment, the movements of puppets or automata are equally valid occasions so far as concerns a system according to the present invention.

The system involves interaction between a performer and an externally generated electromagnetic radiation projected across the zone in which the performance is to be executed, and a plurality of different radiations may be simultaneously so projected, each associated with a different characteristic of the overall accompaniment, whether audible or visual. The radiations may themselves be of different natures such as pulsed or continuous wave; ultrasonic, infrared, ultraviolet etc., to each of which a respective sensor or sensors is tuned so as to respond in a specific mode to the interactions between a performer and the relevant radiation.

Whilst for most purposes the movements of a performer (as defined above) within the performance zone are detected or measured, or both, by sensors responsive to interactions between the performer and electromagnetic radiation, it may sometimes be convenient to detect or measure, or both, lateral displacements of a performer on a stage or equivalent surface by means of strain gauges or other forms of localised proximity sensors which the performer touches or closely approaches, although the relative immobility of such an arrangement restricts it, for most practical purposes, to fixed performance zones.

Whatever the nature of individual sensors in a system of the kind to which the present invention relates, the output of each sensor is fed, either directly or through a control of regulating device, to an audio or visual (or both) output channel which is thus triggered by the movements of each performer.

Interactive performance systems based on the concept of remote control of the net output by the performers themselves in response to their movements in a performance zone have been developed with the object of varying the colour, tone, volume or other characteristic of a prerecorded audio or visual passage. In one such case, visible light beams were used which were interrupted by the movements of a live performer and the interruptions activated sensors controlling sound outputs. Others have attempted to involve live musicians to follow a score which is under continual development in response to movements of live performers, while yet others have fed the outputs of various sensors to computer synthesisers.

Sometimes sensors have been physically attached to the performers' bodies to respond to limb movements or muscular tensions, and in one case these sensors were scanned by infrared beams which then activated spotlight controls so that the performer's movements were followed by the spotlight.

Another system using body sensors to monitor limb and muscle flexure ahd the disadvantage that each performer had to carry a wire or cable connecting the sensors to respective terminals, and these seriously inhibited freedom of movement of individual performers.

One drawback which has been common to the systems hitherto used or proposed has been an inability to distinguish between speed of total displacement of a performer's body and movements of parts only thereof, such as arm or leg gestures.

It is an object of the present invention to provide a system based wholly or mainly on electromagnetic interaction by the performer which seeks to overcome the aforesaid drawbacks and limitations and to offer scope for a greater range of self-accompanied activities.

According to the present invention, an audio or visual output channel is energised by signals initiated by the interaction between a performer in a performance zone and preselected electromagnetic radiation emitted into that zone wherein the radiation is emitted at constant frequency outside the range of human audibility or visibility, and a doppler effect sensor detects the interaction between the performer and the constant frequency radiation to provide signals representative of velocity, while another sensor detects distance from a datum, or shadow on a reference surface, or some other property of the performer's movements, the output of each sensor being continuously fed to a master control unit for energising the audio or visual output channel.

The audio or visual output channel may be a tape deck, or a sound synthesiser, or a variable colour projector, or any combination thereof; or it may be a disc or record player whose output is varied in volume or pitch; or a visual display unit the brightness of hue, or both, of which is varied in accordance with a predetermined programme of responses derived from the sensors.

Preferably, each sensor having a given type of response is arranged to respond to radiation emitted on a particular axis through the performance zone.

Ideally, the outputs of all the sensors are fed to a real time computer or a processor board which is programmable to drive the audio or visual output channel in accordance with a predetermined programme.

Advantageously, sensors are located to respond to radiation emitted on the three cartesian (X, Y, Z) coordinate axes in the performance zone so that a performer's instantaneous position is represented by a unique blend of sensor outputs.

Alternatively, the sensors which respond to a particular radiation may be graded or zoned so as to respond at different levels of intensity at different co-ordinates. Thus, for example, in a performance zone of generally rectangular plan, proximity sensors may be designed with a response curve whose gradient is steeper for those at one end of the zone than at the other, so that performers can deliberately enhance the response to their movements by concentrating at the relevant part of the zone.

Although the performance zone will normally be a stage in the theatrical film set sense—i.e. bounded on all or most sides by walls whose radiation-absorption properties can be predetermined—it is to be understood that it can, in certain circumstances, be an "open air" site.

In a preferred embodiment of the invention an array of sensors, each responsive in a respective specific way to electromagnetic radiation including a doppler effect sensor or sensors and which are capable of functioning interdependently to identify and/or measure velocity of motion and the spatial parameters of a performer or group of performers, are linked by a data transmission system comprising, as appropriate, coaxial or solid cables to a master data processing unit such as a real time computer or a processor board. The output or outputs of this master processing unit is or are fed to any one or more of a variety of transducers including sources of visible light, laser beam emitters, video reproducers, voice and music loud speakers or special effect generators. Electromagnetic radiation transmitters include at least one which is adapted to activate a doppler effect sensor, and is in the form of a microwave transmitter whose output frequency is preferably centered on 10.69 GHz. Other transmitters radiate narrow or broad beams in frequency bands outside the ranges of human visibility and audibility, and include infrared lasers, which can most conveniently be located on the X and Y axes of cartesian coordinates, and ultrasonic emitters. The complete array of electromagnetic radiation transmitters and sensors is preferably arranged to operate in three dimensions (X, Y and Z) cartesian co-ordinate axes).

The output signal from each sensor is relayed to a multi-input processing unit which drives the various required output channels in accordance with a prearranged programme. The processing unit is programmed to operate all or any of these systems in 'real time'—that is, 0–0.5 sec. response time from initiation, depending on the quantity of data processed. Thus, a performer triggers a sensor and sets of individual or sequenced preprogrammed effects, and is able to modify their state, either independently or collectively, by means of varying his speed of movement. Any bodies traversing the same path at the same speed more than once will generate the same output. In addition, a cyclic process of events is achieved by programming lighting, laser and sound effects that transmit back signals to the computer for further sequencing.

Figure 2:
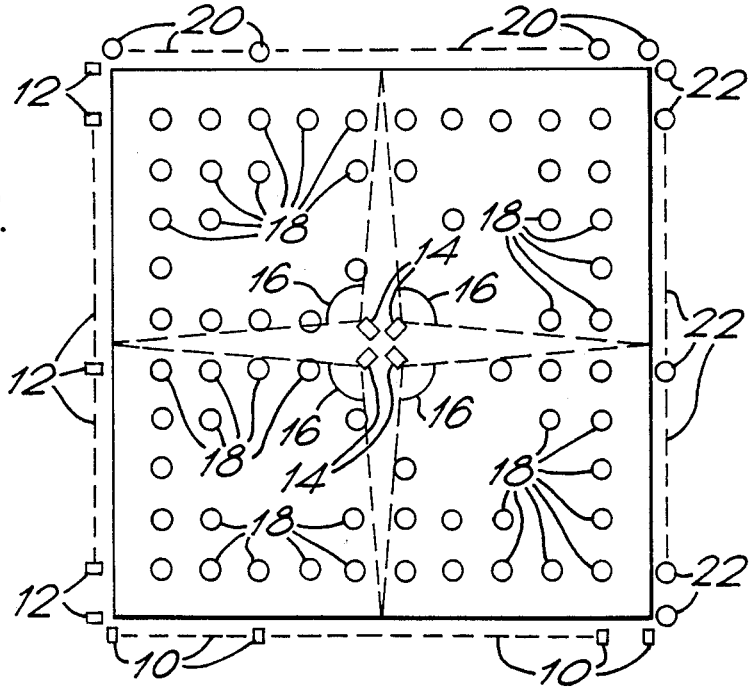

Practical embodiments of the present invention will now be described—purely by way of illustration—with reference to the accompanying drawings in which:

FIG. 1 is a schematic layout of sensors in a performance zone for detecting instantaneous position and speed of motion of a performer, and FIG. 2 illustrates an alternative arrangement.

FIG. 1 is a plan view of a performance zone or stage across which are projected a series of equally spaced infrared laser beams 10, 12 intersecting at right angles to form a rectangular grid pattern of conventional cartesian coordinates on X and Y axes. A doppler microwave transmitter 14 is located at one corner of the performance zone—say, at the origin of the coordinate axes X, Y—to generate in the zone a standing wave pattern represented by the concentric arcs 16. The centre frequency of the doppler transmitter is of the order of 10.69 GHz. The doppler transmitter unit 14 incorporates a sensor which responds to variations in frequency of reflections of the standing wave 16 from a moving target—i.e. a performer on the stage.

Each infrared laser beam 10, 12 impinges on a respective infrared sensor 20, 22 located around the margins of the performance area, such as the walls of a studio or theatre stage, and produce signals whenever their respective beams are interrupted by an opaque object such as a performer. These sensors are wired into a common loom connected to a receiver (not shown) which also incorporates a time base. The receiver produces two outputs, one of which is, or is directly equivalent to, the several inputs from the sensors and represents instantaneous positions of a performer in the coordinate grid (e.g., $x_3$, $y_2$ etc.). The other output is the quotient of a series of instantaneous positional signals from all the sensors 20, 22 scanned at intervals of a few microseconds, and time, and represents speed of travel of a performer over a discrete time interval. Both receiver outputs are fed to a microcomputer which analyses them according to its software programme.

At the same time, signals from the doppler sensor are also fed to the microcomputer. These constitute data representing body movements of a performer, such as hand or arm gestures, dance steps etc. The doppler signals may also represent speeds of movement of groups of performers. These signals are also fed to the microcomputer.

The microcomputer is programmed to process the various items of input data and thus to control audio or visual effects. The sound effects may be produced by a synthesiser or by a tape deck and the visual effects may be provided by an array of spot or flood lights, or a cine film projector or a video display system. Thus, the computer software interprets the data provided by the sensors according to parameters determined by the users of the system. For example, the performer may decide to be 'tracked' by lights when moving around the stage and this is achieved by the computer programme processing the infrared signals to control lights already fixed on the coordinates prior to the performance. Furthermore, the performer's average speed of movement (updated every few microsecs) would be calculated from information obtained from the infrared sensors, and this is important as it ensures 'smooth tracking' i.e. not jerking from one coordinate to another.

The speed of limb or body movements, detected by the doppler 14, is also relayed to the computer in the form of voltage, changes and, in the case of 'tracking' lights, it would be used to control the iris, colour selection, and/or light intensity; e.g. fast movements (higher voltages) select red or orange, small iris with near maximum light intensity. This opening would be determined by the user, who may, at will, decide on the opposite effects with the same speed of body movement. The user is free to combine any number of effects from different audio/visual hardware sources substantially simultaneously, and, using a timing system can cue in a new set of effects.

In the alternative layout shown in FIG. 2, four doppler units 14 are mounted overhead so that their respective standing wave patterns 16 abut to give 360° coverage. The floor or stage has pressure pads or strain gauges 18 set at regular spacings over the entire surface (not all such pads 18 are illustrated) and infrared systems 10, 20 and 12, 22 may also be located as in FIG. 1. The infrared system 10, 20 and 12, 22; doppler 14, 16 and floor mounted pressure sensors 18 are laid out to the specification of the performers who will have choreographed their movements very precisely in order to get the desired effect. For example, they may decide to give the impression of plucking out of space synthesized sounds or lighting effects; laser, or video images.

Another application of a system according to the present invention is an adventure game in which one or more performers attempts to follow a sequence of movements which has been stored in a standard storage device such as a tape, disc, "eprom" or the like. The data in the storage device are fed into a computer, and the responses of the sensors to interference by a performer are compared with the preprogrammed values.

We claim:

1. A method of controlling an audio and/or visual output signal channel by interacting a mobile performer in a performance zone with preselected externally generated radiation, comprising:

providing a performance zone;

emitting into said performance zone a preselected electromagnetic radiation at a substantially constant frequency outside the limits of human audibility or visibility;

detecting interference between said preselected radiation and the performer by sensing the doppler effect and providing a first output related thereto;

providing in said performance zone an array of transmitters and receivers arranged on mutually perpendicular axes and forming a lattice of invisible rays in at least two dimensions across said performance zone;

detecting interference with said rays and the performer and providing a second output related thereto; and using said first and second outputs to set off individual or pre-programmed sequences of audio and/or visual effects.

2. The method according to claim 1 including providing a real time computer programmed for driving an audio or visual output channel and coupling said first and second outputs to said real time computer.

3. The method according to claim 1 including forming said invisible rays from radiation different from said preselected electromagnetic radiation.

4. The method according to claim 1 including providing a third transmitter and irradiating said performance zone on an axis perpendicular to said lattice of invisible rays and detecting interference with said perpendicular radiation by said performer and providing an output related thereto.

5. The method according to claim 1 including generatng an output proportional to the mean speed of traverse of the performance zone by said performer from the said second output.

6. The method according to claim 1 wherein said first and second outputs are related to different physical parameters related to the performance.

7. An apparatus for controlling an audio and/or visual output signal channel by interacting a mobile performer in a performance zone with preselected externally generated radiation, comprising:

a performance zone;

means for emitting into said performance zone a preselected electromagnetic radiation at a substantially constant frequency outside the limits of human audibility or visibility;

means for detecting interference between said preselected radiation and the performer including means for sensing the doppler effect and means for providing a first output related thereto;

an array of transmitters and receivers arranged on mutually perpendicular axes including means for forming a lattice of invisible rays in at least two dimensions across said performance zone;

means for detecting interference with said rays and the performer and means for providing a second output related thereto; and means for using said first and second outputs to set off individual or pre-programmed sequences of audio and/or visual effects.

8. The apparatus according to claim 7 including a real time computer programmed for driving an audio or visual output channel and means for coupling said first and second outputs to said real time computer.

9. The apparatus according to claim 7 including means for forming said invisible rays from radiation different from said preselected electromagnetic radiation.

10. The apparatus according to claim 7 including a third transmitter including means for irradiating said performance zone on an axis perpendicular to said lattice of invisible rays and means for detecting interference with said perpendicular radiation by said performer and means for providing an output related thereto.

11. The apparatus according to claim 7 including means for generating an output proportional to the mean speed of traverse of the performance zone by said performer from the said second output.

12. The apparatus according to claim 7 wherein said first and second outputs are related to different physical parameters related to the performance.

* * * * *